US010745931B1

(12) United States Patent
Gathers et al.

(10) Patent No.: US 10,745,931 B1
(45) Date of Patent: Aug. 18, 2020

(54) SELF-RIGHTENING POST SYSTEM

(71) Applicant: Premises Innovations LLC, Indianapolis, IN (US)

(72) Inventors: Garth N. Gathers, Indianapolis, IN (US); Timothy J. O'Brien, Indianapolis, IN (US)

(73) Assignee: PREMISES INNOVATIONS LLC, Indianapolis, IN (US)

( * ) Notice: Subject to any disclaimer, the term of this patent is extended or adjusted under 35 U.S.C. 154(b) by 0 days.

(21) Appl. No.: 16/791,961

(22) Filed: Feb. 14, 2020

Related U.S. Application Data

(63) Continuation-in-part of application No. 16/540,371, filed on Aug. 14, 2019, now Pat. No. 10,568,449.

(51) Int. Cl.
*E04H 12/22* (2006.01)

(52) U.S. Cl.
CPC ..... *E04H 12/2284* (2013.01); *E04H 12/22* (2013.01); *E04H 12/2269* (2013.01)

(58) Field of Classification Search
CPC ..... E04H 12/2284; E04H 12/2269; A47G 29/1216; F21S 8/081; F21V 21/10; F21V 21/14; F21V 15/00; F21V 15/04; E01F 9/627; E01F 9/017; E01F 9/608; E01F 9/685; E01F 9/588; E01F 9/681; E01F 9/629; E01F 5/80; A45F 3/44; Y10T 403/459; Y10T 403/45
USPC ..... 248/622, 624, 156, 158, 160, 170, 371, 248/372.1, 398, 548, 560, 900, 417, 551, 248/573, 575
See application file for complete search history.

(56) References Cited

U.S. PATENT DOCUMENTS

| | | | |
|---|---|---|---|
| 1,771,817 | A | 8/1929 | Ragsdale |
| 1,866,982 | A | 7/1932 | Michener |
| 1,903,683 | A | 4/1933 | Nute |
| 2,883,133 | A | 4/1959 | Zarate |
| 4,161,723 | A | 7/1979 | De Vittori |
| 4,448,003 | A | 5/1984 | Hasbrouck |
| 4,522,530 | A | 6/1985 | Arthur |
| 4,737,048 | A | 4/1988 | Herrstrom |
| 5,000,414 | A | 3/1991 | Rosato |
| 5,044,587 | A | 9/1991 | Degen |
| 5,375,808 | A | 12/1994 | Roy |
| 5,626,418 | A | 5/1997 | Angelis, Sr. et al. |
| 5,795,579 | A | 8/1998 | Krinner |
| 6,886,296 | B1 | 5/2005 | John et al. |
| 7,278,240 | B2 | 9/2007 | Burkart et al. |
| 7,824,082 | B2 | 11/2010 | Hanson |

(Continued)

*Primary Examiner* — Nkeisha Smith
(74) *Attorney, Agent, or Firm* — Invention to Patent Services; Alex Hobson

(57) ABSTRACT

A self-rightening post system is configured to secure a post in a casing in a desired or vertical orientation and to self-righten the post upon the removal of a deflecting force, such as from a car or lawnmower. A self-rightening post system utilizes a plurality of adjustable retainer assemblies that are configured around the post and coupled to a collar. Each of the adjustable retainer assemblies has an adjustment extension with a threaded portion in the collar to change the compression of a spring extending therefrom toward the post. A post flange may be coupled to the post end of the spring to provide a planar surface for exerting a retaining force on the post. The collar is configured over a casing and configured to rotated with respect to the casing. Retainer extensions extend from the collar down along the casing to secure the collar in position.

21 Claims, 12 Drawing Sheets

(56) References Cited

U.S. PATENT DOCUMENTS

| | | | |
|---|---|---|---|
| 7,849,617 | B2 | 12/2010 | Intagliata et al. |
| 9,452,588 | B2 | 9/2016 | Sanderson et al. |
| 2005/0002183 | A1 | 1/2005 | Wardzala |

SELF-RIGHTENING POST SYSTEM

CROSS REFERENCE TO RELATED APPLICATIONS

The application is a continuation in part of U.S. patent application Ser. No. 16/540,371, filed on Aug. 14, 2019 and currently pending.

BACKGROUND OF THE INVENTION

Field of the Invention

The invention relates to a self-rightening post system that elastically restrains a post in a vertical orientation with adjustable retainer assemblies.

Background

Posts are used to secure any number of items including mailboxes, lights, signs and fencing, bird feeders and the like. These posts are typically secured in the ground and sometimes have cement configured around the portion of the post in the ground. Unfortunately, posts can be deflected by contact with a car or lawnmower and this leaves the post extending up from the ground at a tilted angle. This can be very unappealing to many homeowners and neighbors. In addition, some posts simply tilt overtime due to settling of the ground, again leaving a tilted post. To correct these drawbacks of a tilted post extension, the post can be forced back into a straight or vertical orientation but this can be short lived as the ground or support has been compromised. Alternatively, the post can be dug up and removed and then re-set in a vertical orientation. When the post has been set with concrete, this can be very difficult work, as the concrete will be adhered to the post.

Likewise, a post can sometimes be set in the ground or within a casing and the angle may be undesirable. Also, a post can be deflected out of desired rotational alignment by an object such as a car or lawnmower and this can also cause problems. A mailbox that does not face the road can look awkward and can be difficult for a mail carrier to access. It can be very difficult if not impossible to righten a post rotationally when secured in the ground.

SUMMARY OF THE INVENTION

The invention is directed to a self-rightening post system configured to secure a post in a casing in a vertical orientation and to self-righten the post upon the removal of a deflecting force, such as from a car or lawnmower. An exemplary self-rightening post system utilizes a plurality of adjustable retainer assemblies that are configured between the post and the inside surface of the casing to produce a self-rightening force upon deflection of the post. The plurality of adjustable retainer assemblies may be configured around the post and/or on opposing sides of the post to ensure that the post will self-righten regardless of the direction of a deflecting force.

An exemplary adjustable retainer assembly comprises a post contact extension that is coupled to the post and a casing extension coupled to the post contact extension by a hinge. On an adjustment end of the adjustable retainer assembly an adjustment extension, such as a bolt, extends from the post extension to the casing extension and can adjust a retainer distance, or distance between the casing extension and the post extension. A spring is configured in compression between the post and casing extensions and produces a separating force that the adjustment extension can overcome to change the distance between the post and casing extensions. The retainer distance can be changed to create a force on the post wherein the casing extension is forced against the casing and the post is forced by the post extension.

In an exemplary embodiment, a post is rectangular in cross-sectional shape and there are four adjustable retainer assemblies configured on each of the four sides of the post. The casing may be a tube having a circular cross-sectional shape and a casing interface contoured to the inner diameter of the casing and coupled to the casing extension may enable the post and the self-rightening post system to rotate within the casing. This can further reduce any damage that might be caused by an object hitting the post. Also, this enables a user to simply rotate the post to a desired orientation after a deflection.

In an exemplary embodiment, a post is circular in cross-sectional shape and there are at least three adjustable retainer assemblies configured around the post, preferably at uniform angular offset positions, such as at about 120 degrees apart for a system having three adjustable retainer assemblies. The post extensions may have a curved surface to enable a secure engagement with the circular outer surface of the post. Again, the casing may be a tube having a circular cross-sectional shape and a casing interface coupled to the casing extension may enable the post and the self-rightening post system to rotate within the casing.

An exemplary adjustable retainer assembly comprises a bolt as an adjustment extension and a threaded adjustment aperture is configured in the post extension to allow the threads of the bolt to change the retainer distance. The polygonal head, or bolt head, may be secured to the casing extension by an adjustment flange and extend through an adjustment aperture in the casing extension. The extended end, or threaded end, of the bolt may extend out from the post extension and into an aperture in the post, to allow the bolt to change the retainer distance. The adjustable retainer assemblies may be secured to the post by post extension fasteners.

When the post is deflected, one or more of the adjustable retainer assemblies will be compressed and those on an opposing side, the side receiving the deflection force from an object, will be pulled away from the casing. Upon removal of the deflecting force, the compressed adjustable retainer assemblies will force the post back to a straight and vertical orientation.

An exemplary self-rightening post system can be used to position a post in a desired orientation and most often in a vertical orientation, regardless of the casing orientation. For example, a casing may be offset an offset angle from vertical and an exemplary self-rightening post system can be used to force the post vertical within the offset casing. Each of the adjustable retainer assemblies can be adjusted separately to produce more force on one side of the post to force the post vertical within an offset casing. The gap distance between the post and the casing may therefore be different from side to side of the post.

An exemplary spring, as used herein, may be a coiled spring, or an elastomeric material, a material that returns substantially to an original orientation after removal of a deflecting force, such as within about 90% of an original deflected dimension. An elastic spring may therefore be an elastomer, such as silicone, urethane, rubber and the like. A coiled spring may be retained between the casing and post extensions by guide posts that extend within the coil of the coiled spring. These spring guide posts may ensure that the spring stays in an aligned position between the post and casing extensions.

An exemplary self-rightening post system comprises a top plate that is configured around the post above the casing. An exemplary top plate has an aperture to receive the post and may comprise a flange to prevent dirt, debris and water from getting into the casing. The top plate may slide freely over the casing to enable the post to deflect and then return back to an original orientation.

An exemplary self-rightening post system comprises a base retainer that extends between the post and the casing below the plurality of adjustable retainer assemblies, such as proximal to the bottom of the casing and also proximal to the extended or inserted end of the post. The base retainer may comprise a recess or aperture to receive the inserted end of the post and may retain the inserted end in a central location in the casing.

An exemplary self-rightening post system may utilize a plurality of adjustable retainer assemblies that are coupled to a collar to provide a spring force against the post to retain the post in a desired vertical orientation and to enable the post to self-righten upon deflection of the post by a deflecting force. An exemplary adjustable retainer assembly has an adjustment extension that is threaded through a threaded collar aperture. An adjustment feature, such as a nut or polygonal adjustment head, coupled to the adjustment extension, may be used to move the adjustment extension into and out of the collar, whereby turning the adjustment feature a first direction turns the adjustment extension in the threaded collar aperture to move the adjustment extension out from the collar and turning the adjustment feature an opposing second direction moves the adjustment extension inward or into the collar. An exemplary adjustment feature of an adjustable retainer assembly may be a bolt and the head of the bolt may form the adjustment feature. The adjustment feature may be configured on the inside of the collar to allow easy manipulation from above the collar such as when the collar is configured in the ground.

A spring is coupled to the adjustment extension and extends from an attached end to a post end. An adjustment spring coupler may couple the adjustment extension to the attached end of the spring, and may be cylindrical in shape and extend into the interior of the spring coil to secure the spring to the adjustment spring coupler. The adjustment feature may be configured between the adjustment extension and the adjustment spring coupler. An adjustment flange may be configured between the spring and the adjustment extension and may be coupled with the adjustment spring coupler. The adjustment flange may be a disc shaped flange that is larger in diameter than the diameter of the coiled spring, such as 1.5 times larger, or twice as large in diameter than the spring diameter. A post spring coupler may be configured on the post end of the spring and may include a post flange to provide a planar surface for exerting the force of the spring onto the post and to retain the post end of the spring. A post flange may be a disc shaped flange that is larger in diameter than the diameter of the coiled spring, such as 1.5 times larger, or twice as large in diameter than the spring diameter. The post spring coupler may be cylindrical in shape and extend inside of the coil of the spring. The spring may have a free spring portion that extends a free spring length, or portion that extends freely for compression and expansion of the spring. The free spring portion may be between the post spring coupler and the adjustment spring coupler. A free spring length may enable flexing and deflection of the spring as a post is deflected by a deflecting force. Again, an adjustment spring coupler may extend within the spring and be cylindrical in shape and may have an adjustment flange to retain the attached end of the spring.

A plurality, or at least three, of the adjustable retainer assemblies may be configured around a post and extend through the collar. The collar may be a ring and may be configured over a casing. A retainer extension coupled to the collar may extend down along an inside or outside surface of the casing to secured the collar to the casing but allow the collar to spin with respect to the casing. It may be preferred that the retainer extension extend along an inside surface of the casing as the inside may be free of debris, such as when the casing is secured directly in the ground. It may be desirable to have a plurality of discrete retainer extensions to reduce friction between the inside surface of the casing and the retainer extension to allow for easy insertion and to allow the post to be spun without damaging the post or the adjustable retainer assemblies. An exemplary discrete retainer extension may extend a portion around the casing, such as no more than 120 degrees, no more than 100 degrees, no more than about 90 degrees and any range between and including the values provided. An exemplary self-rightening post system may employ two or more discrete retainer extensions, or three or more, or five or more and they may be configured about the inner perimeter of the collar, and preferably uniformly distributed about the inner perimeter.

A casing may be configured at least partially within the ground or be submerged or maybe configured above the ground. A casing may be circular in cross-sectional shape, such as being a tube, or may be rectangular, polygonal shaped or irregular shaped. A casing may be formed by an aperture in a material, such as within a poured concrete slab, PVC tubing, for example.

Rectangular, as used herein, includes four sided polygonal shapes and includes square shapes.

A hinge may be a hinge comprising a post and cylindrical elements that extend around the post to enable rotation, or a living hinge that comprises a bent portion of a single piece of material such as a bend in a piece of metal or plastic between the post extension and the casing extension. Note too that a hinge may be a coupling between the post extension and casing extension, such as a weld or other attachment including an attachment comprising fasteners, such as bolts.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
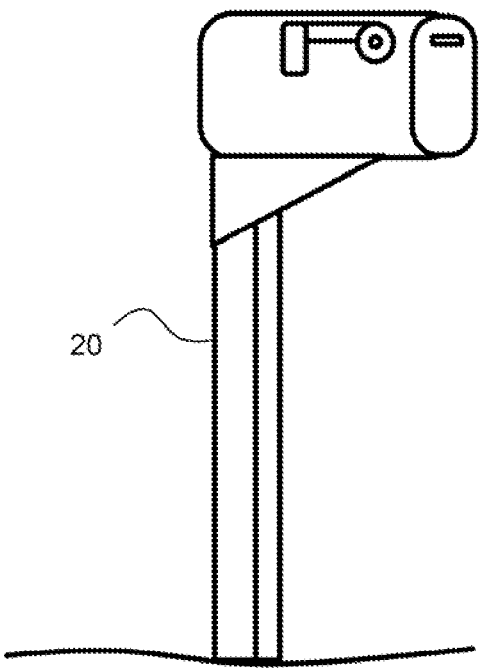
FIG. 1 shows a perspective view of a post extending up from the ground in a vertical orientation and a mailbox coupled to the elevated end of the post.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 2:
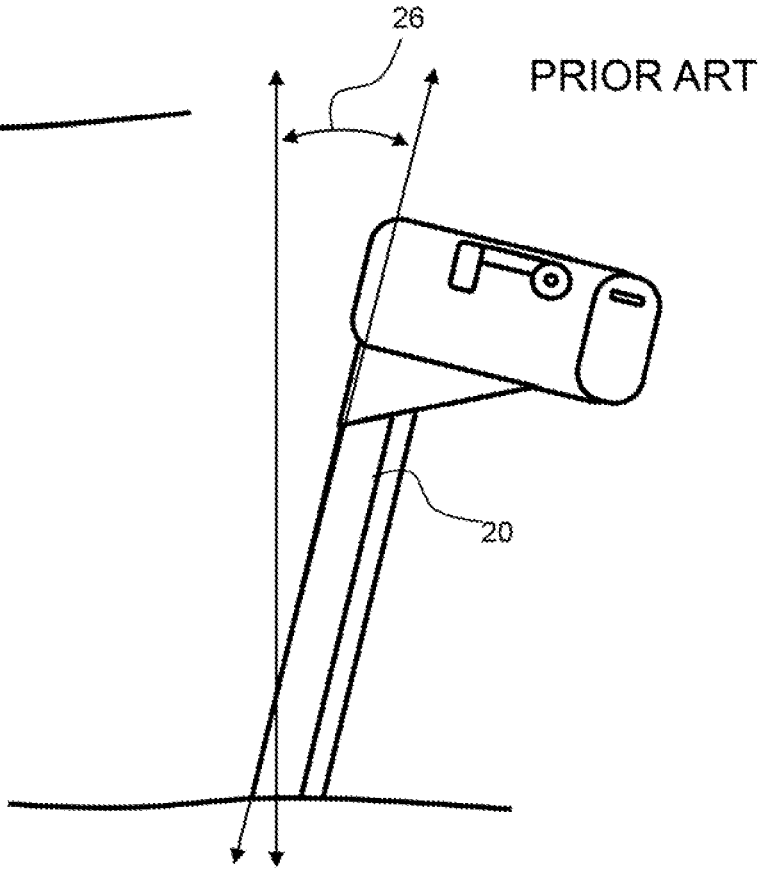
FIG. 2 shows a perspective view of a post that has shifted from a vertical orientation an offset angle.

Referring to FIGS. 1 and 2, shows a perspective view of a post extending up from the ground in a vertical orientation and a mailbox coupled to the elevated end of the post posts 20 are often retained in a hole in the ground with cement configured around the submerged portion of the post. Still other posts are coupled to a plate that is secured to the ground. In the event the post is knocked by an object, such as a lawnmower or car, the post will be deflected from a vertical orientation, as shown in FIG. 1, to an offset angle 26 from vertical, as shown in FIG. 2. Correcting this can be challenging and very labor intensive. In the case of a post retained in a hole with concrete, the post may have to be removed and replaced.

Figure 3:
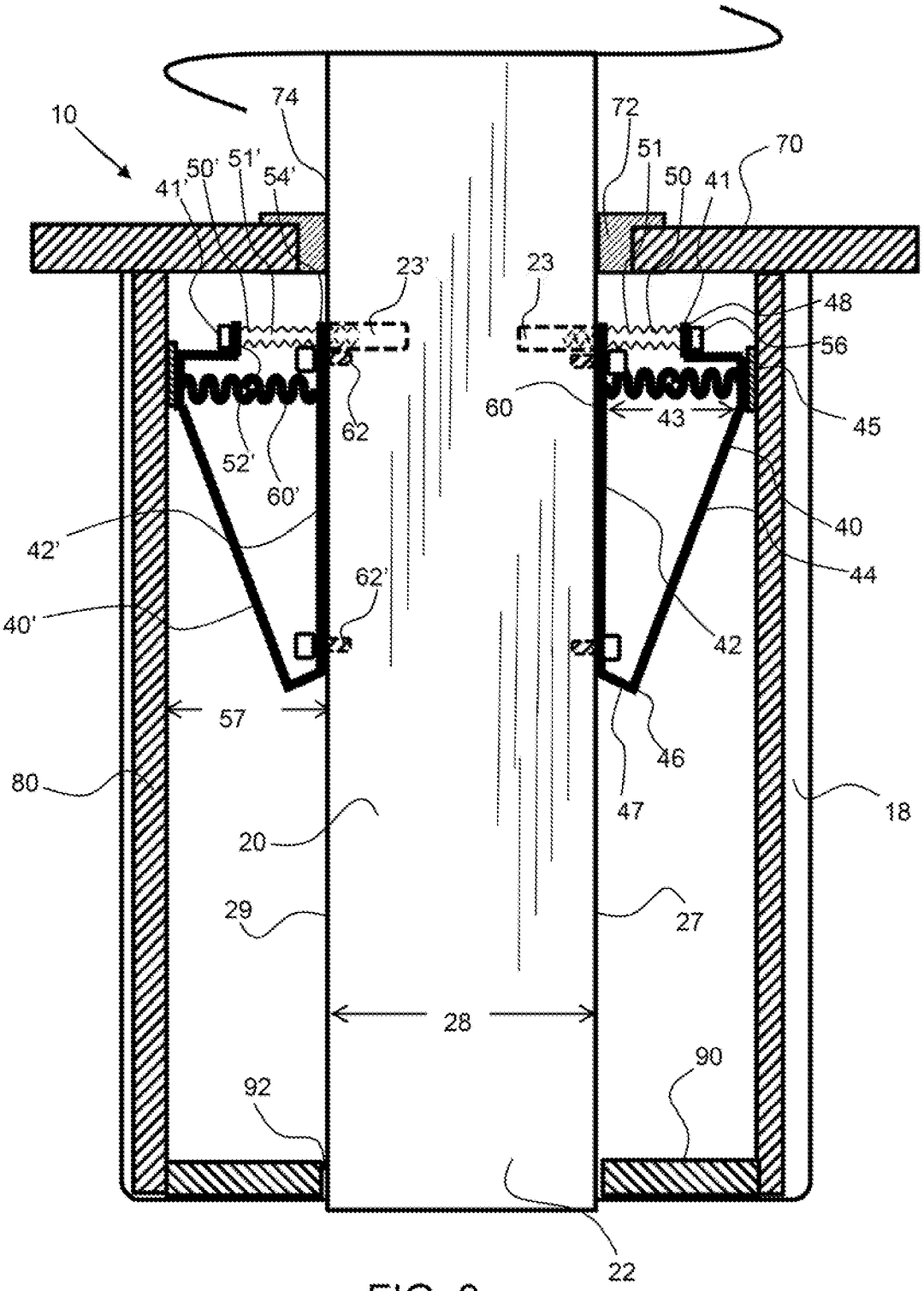
FIG. 3 shows a side view diagram of an exemplary self-rightening post system comprising a plurality of adjustable retainer assemblies that press on the post to keep it in a vertical position.

As shown in FIG. 3, an exemplary self-rightening post system 10 comprises a plurality of adjustable retainer assemblies 40, 40' that applies force on the post to keep it in a vertical position. Note that this FIG. 3 is a cross sectional diagram and that adjustable retainer assemblies may be configured on all four sides of a rectangular or square post. In the case of circular posts, three adjustable retainer assemblies may be required to maintain a vertical orientation. The post 20 extends down into a hole 18 and into a casing 80. Note that the casing may be configured above the ground as well. The post has an insert end 22 that is retained by a base retainer 90 having a base-post receiver 92, or recess or aperture to receive the insert end of the post. The post extends through a top plate aperture 74 in a top plate 70 and a top-plate flange 72 fills the gap between the post and the top plate aperture and prevents water and debris from entering the casing. The top-plate flange may be elastic and may compress when the post is deflected by a force. In an exemplary embodiment, the top plate aperture is larger than the post to allow the post to slide through the aperture for installation. However, the top plate will slide on top of the casing and be shifted when the post is deflected to a higher offset angle. The post has a width 28 from a first side 27 to a second side 29 and this width may be smaller than the top plate aperture.

Figure 5:
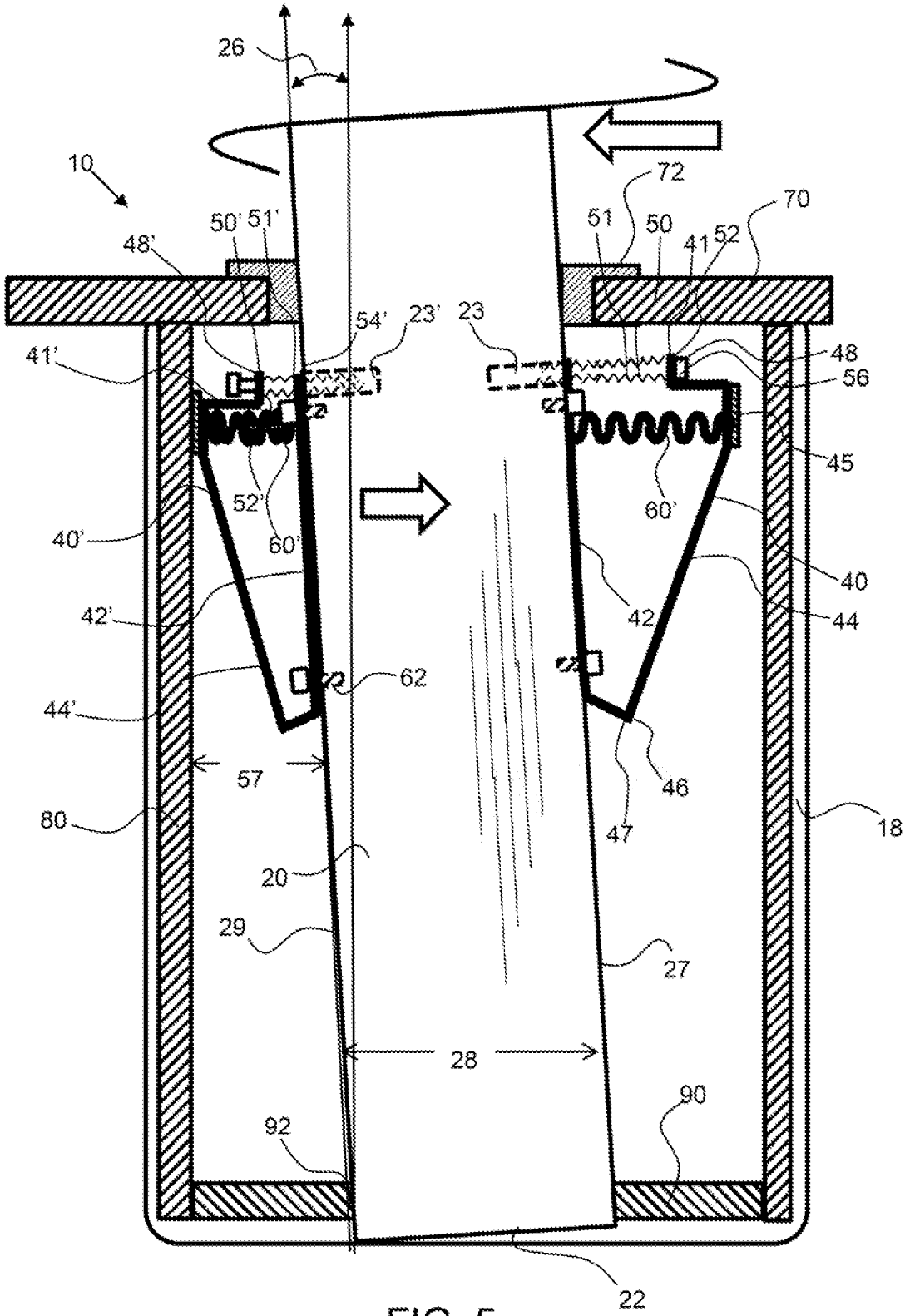
FIG. 5 shows a side view diagram of the exemplary self-rightening post system shown in FIG. 3, with the post deflected by a force to an offset angle from vertical and the adjustable retainer assemblies forcing the post back toward a vertical orientation.

The exemplary self-rightening post system shown in FIGS. 3 and 5 comprises adjustable retainer assemblies 40, 40' that produce opposing forces on the post 20. The adjustable retainer assemblies extend from an adjustment end 41 to a hinge end 47, configured down in the casing or hole. A post-contact extension 42 extends from the adjustment end, along a surface of the post, down to the hinge end and is secured to the post by a plurality of post extension fasteners 62, 62'. A casing extension extends from the hinge 46 on the hinge end back up to the adjustment end. On the adjustment end, an adjustment extension 50, such as a bolt 51 extends from the casing extension to a threaded adjustment aperture 54 in the post-contact extension. A threaded adjustment aperture 54 in the post-contact extension 42 enables the adjustment of the retainer distance 43, the distance between the post contact extension and the casing extension. This retainer distance 43 is set to fill the gap distance 57 between the post 20 and the casing 80 to provide force against the post. A spring 60 is in compression and presses or forces the post-contact extension away from the casing extension. The bolt head 56 of the bolt 51 can be turned to overcome the spring force and reduce the retainer distance 43 between the post-contact extension and the casing extension. The spring will then maintain a force at this preset retainer distance between the casing 80 and post 20. The bolt 51 extends through an adjustment aperture 52 in the adjustment flange 48 and this aperture may be larger than the shank of the bolt to allow it to slide therein. The extended end of the bolt 51 may extend through the threaded adjustment aperture in the post contact extension and into a post aperture 23 in the post. When the gap distance 57 is small, the bolt may be threaded through the threaded adjustment aperture 54 and extend into this post aperture 23, as shown in FIG. 5.

Figure 4:
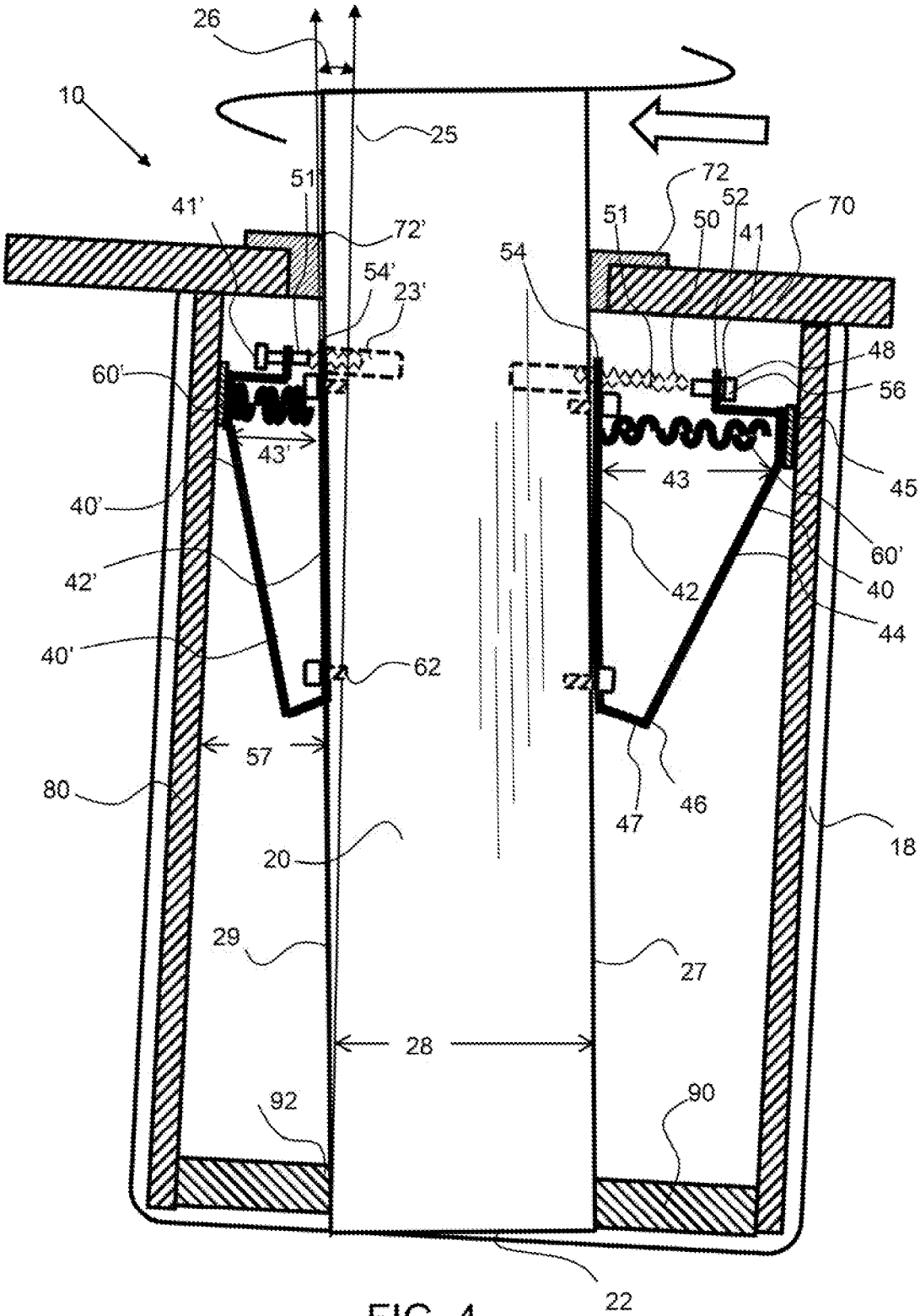
FIG. 4 shows a side view diagram of the exemplary self-rightening post system configured in a casing that is configured at an offset angle and the adjustable retainer assemblies are adjusted to have the post extend vertically from the offset casing.

As shown in FIG. 4, the casing 80 is configured at an offset angle 26 from vertical or from the vertical axis 25. The adjustable retainer assemblies 40, 40' are independently adjusted to force the post into a vertical orientation along the length of the post even though the casing is offset. The adjustable retainer assembly 40 is adjusted to have a larger retainer distance 43 than the retainer distance 43' of adjustable retainer assembly 40' and this differential in retainer distance maintains the post in a vertical orientation.

As shown in FIG. 5, the post is knocked from the vertical orientation to an offset angle 26, and has moved the top-plate 70 to be offset over the casing 80. The adjustable retainer assembly 40' is pressing against the second side 29 of the post 20 to align it back to a vertical orientation. The adjustable retainer assembly 40 is pulled away from casing and produces no counter force on the post. An exemplary adjustable retainer assembly 40 has a retainer distance 43 between the post contact extension 42 and the casing extension 44 that is set by the adjustment extension 50 and spring 60. The spring is in compression and presses the post contact extension 42 and the casing extension 44 apart or away from each other. The adjustment extension 50, such as a bolt, extends into a threaded adjustment aperture 54 of the post contact extension and may be adjusted to change the maximum resistance distance. As shown in FIG. 5, the adjustable retainer assembly 40' is compressed by the offset post and therefore the adjustment extension, bolt head, may be forced through the adjustment aperture 52' in the adjustment flange 48'. Note too that the top plate 70 is shifted due to the offset post angle 26.

Figure 6:
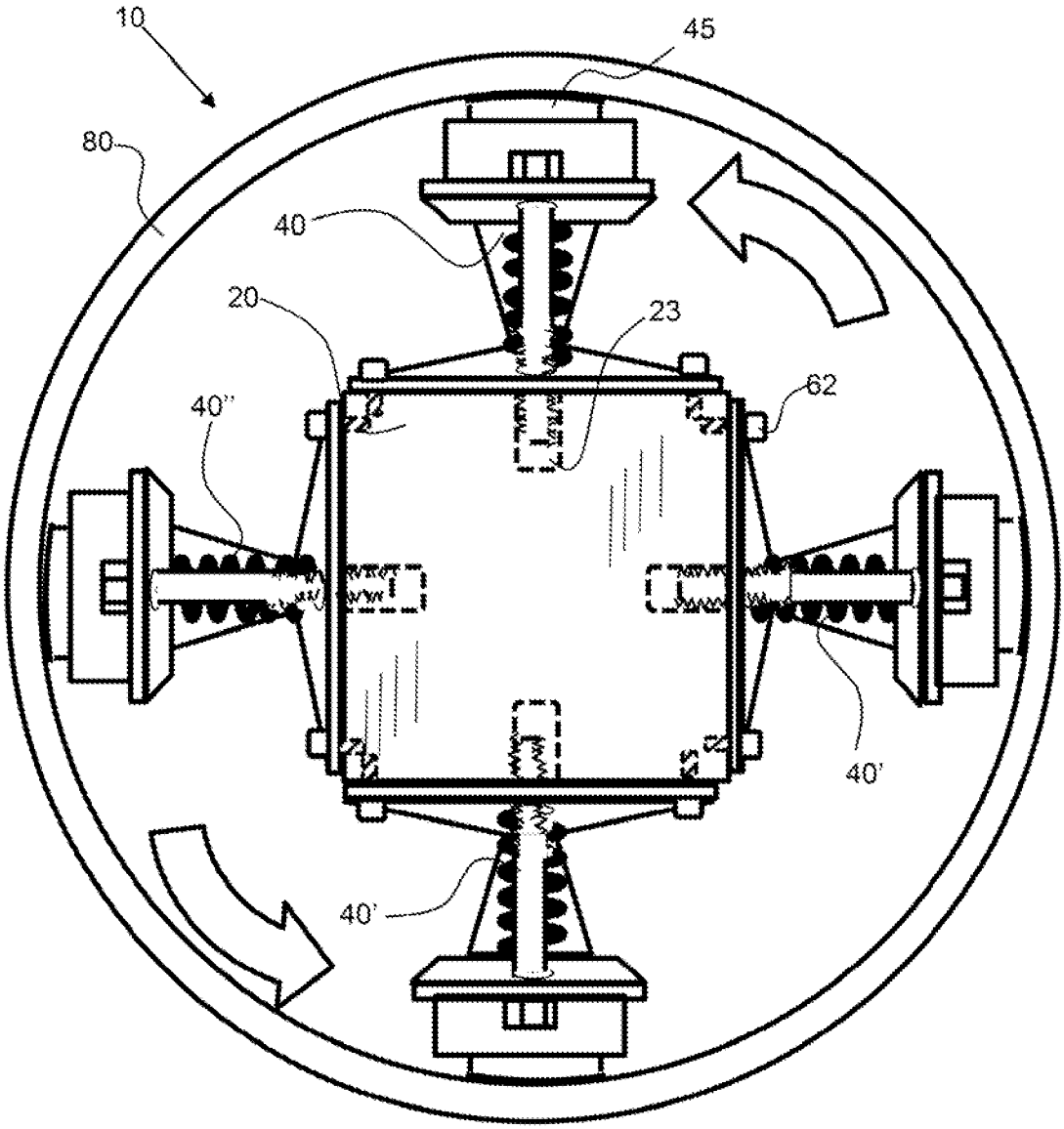
FIG. 6 shows a top view of an exemplary self-rightening post system having four adjustable retainer assemblies configured between each of the four sides of the post and the inside of the casing.

As shown in the top down view of FIG. 6, there are four adjustable retainer assemblies 40-40", with one configured on each of the four post sides. Also, the exemplary casing interfaces 45 have a curved outer surface to match the contour of the casing. Note that the casing may be rectangular and have planar surface and in these cases the casing interface may also be planar. The exemplary self-rightening system 10 shown enables the post to rotate. This enables a user to rotate the post and any device coupled thereto, such as a light or mailbox to a desired position, without digging up the post and repositioning it. The post contact extensions 42 are retained into the post 20 by the post extension fasteners 62.

Figure 7:
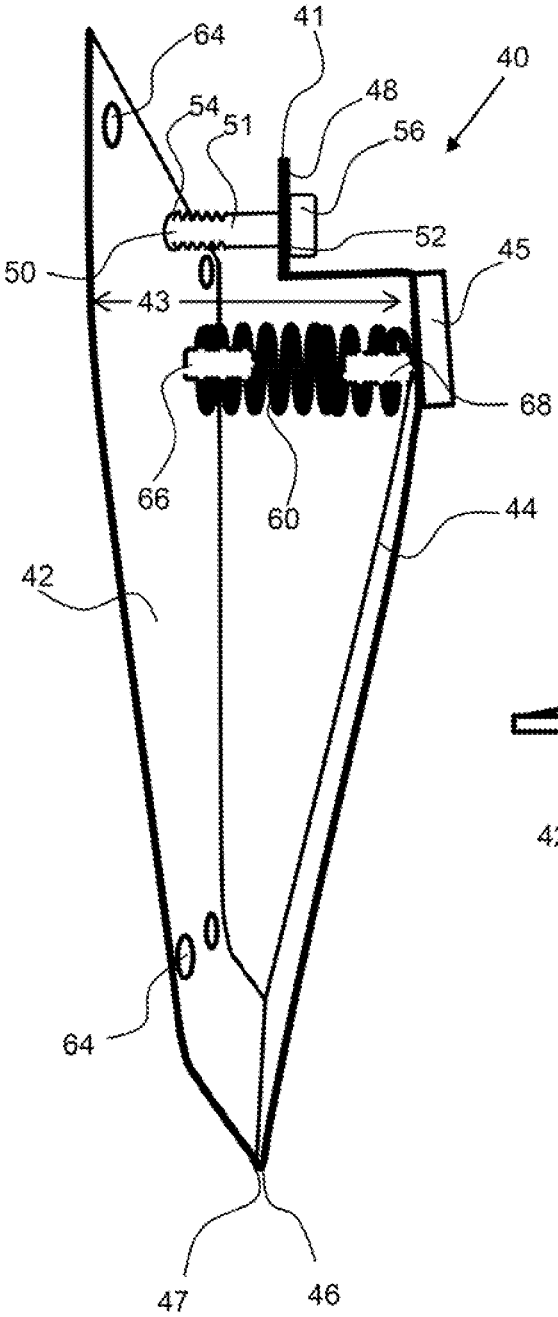
FIG. 7 shows a side perspective view of an exemplary adjustable retainer assembly.
Figure 8:
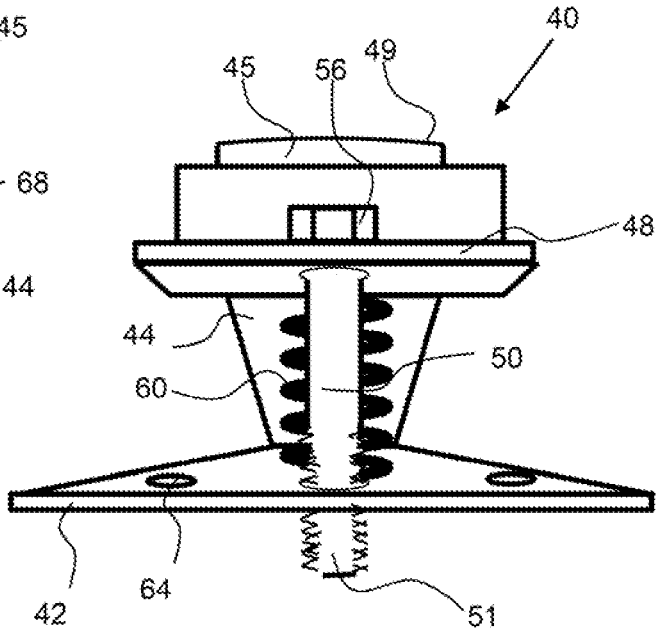
FIG. 8 shows a top adjustment end view of an exemplary adjustable retainer assembly.
Figure 9:
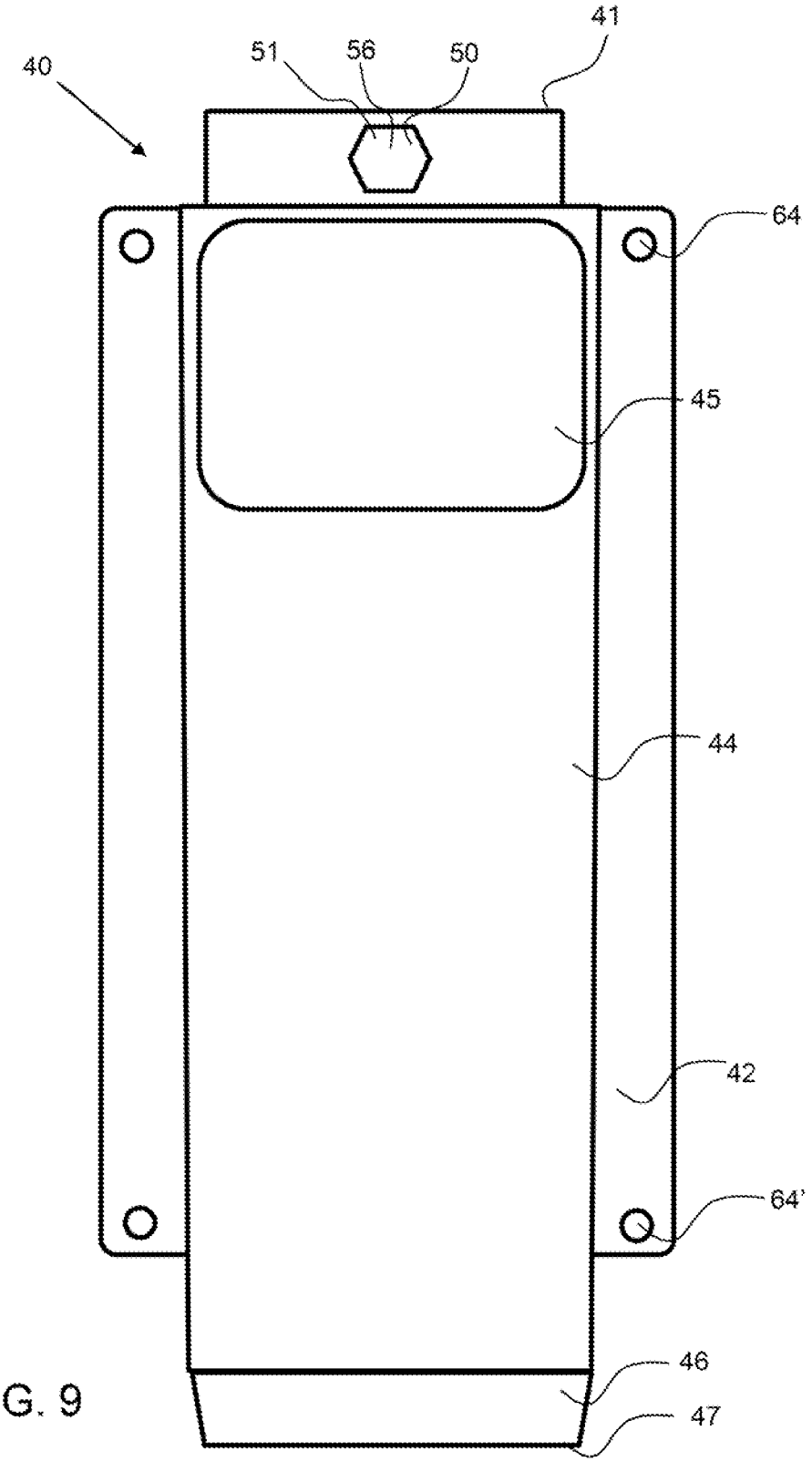
FIG. 9 shows a front casing extension view of an exemplary adjustable retainer assembly.

Referring now to FIGS. 7 to 9, an exemplary adjustable retainer assembly 40 has a retainer distance 43 between the post contact extension 42 and the casing extension 44 that is set by the adjustment extension 50 and retained by the spring 60 that is in compression. The spring presses the post contact extension 42 and the casing extension 44 apart or away from each other. A post extension guide post 66 may extend from the post contact plate up into the spring and a casing extension guide post 68 may extend into the spring from the casing extension to keep the spring aligned between the two opposing extensions or plates. The adjustment extension 50, such as a bolt, extends into a threaded adjustment aperture 54 of the post contact extension and may be adjusted to change the maximum resistance distance. The post contact extension has a plurality of post extension fastener apertures 64, to attach the post extension to the post, such as by screws or bolts. As shown in FIG. 9, the casing interface 45 is configured on an outer surface of the casing extension 44.

Figure 10:
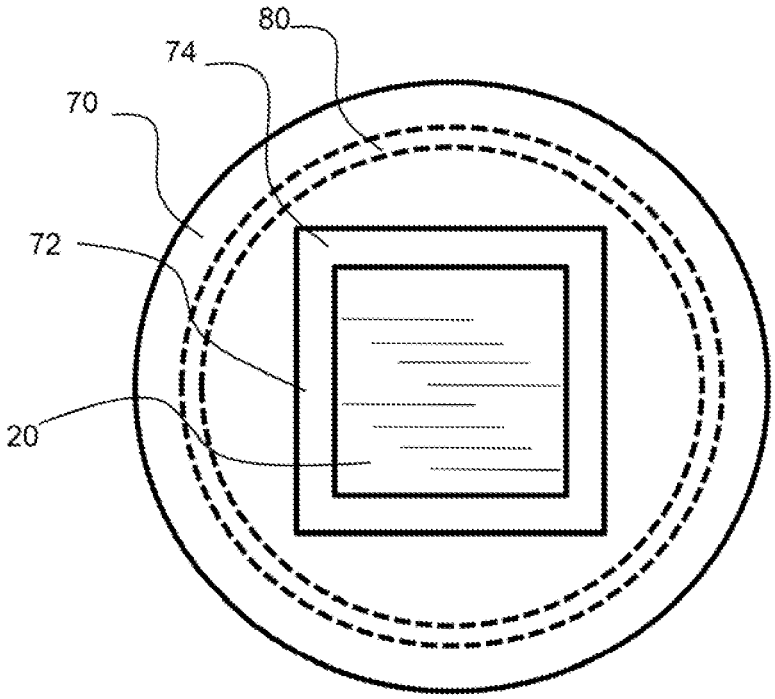
FIG. 10 shows a top view of a vertical post extending through a top plate of an exemplary self-rightening post system.
Figure 11:
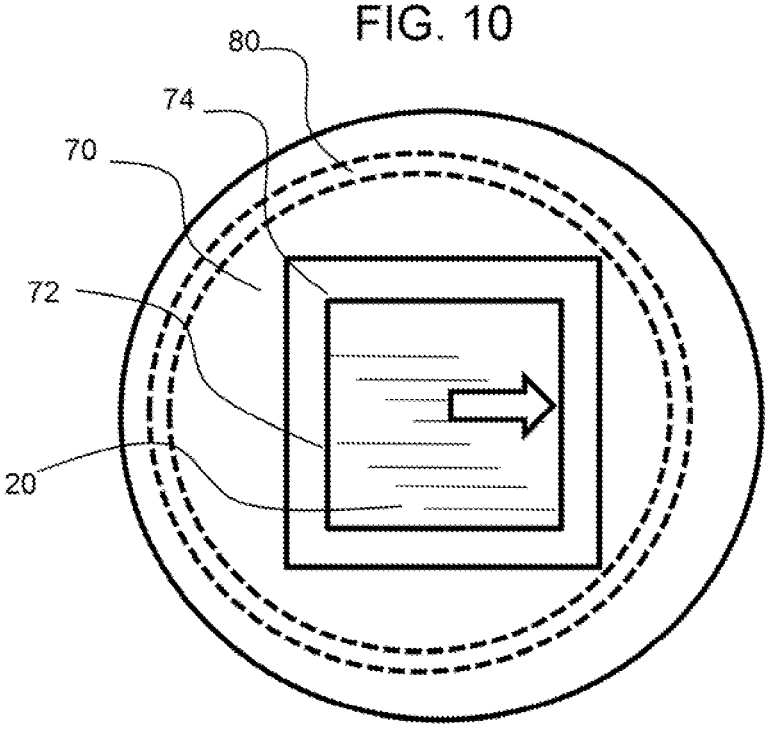
FIG. 11 shows a top view of a post that is offset extending through a top plate of an exemplary self-rightening post system at an offset angle, wherein the plate aperture is shifted by the offset post with respect to the casing.

Referring now to FIGS. 10 and 11, a post 20 is extending through a top plate 70 of an exemplary self-rightening post system and is substantially aligned vertically in the casing in FIG. 10. However, in FIG. 11, the post is now at an offset angle or deflected and the post has shifted the top plate 70 with respect to the casing 80. The post will self-righten and the top plate will shift back into position.

Figure 12:
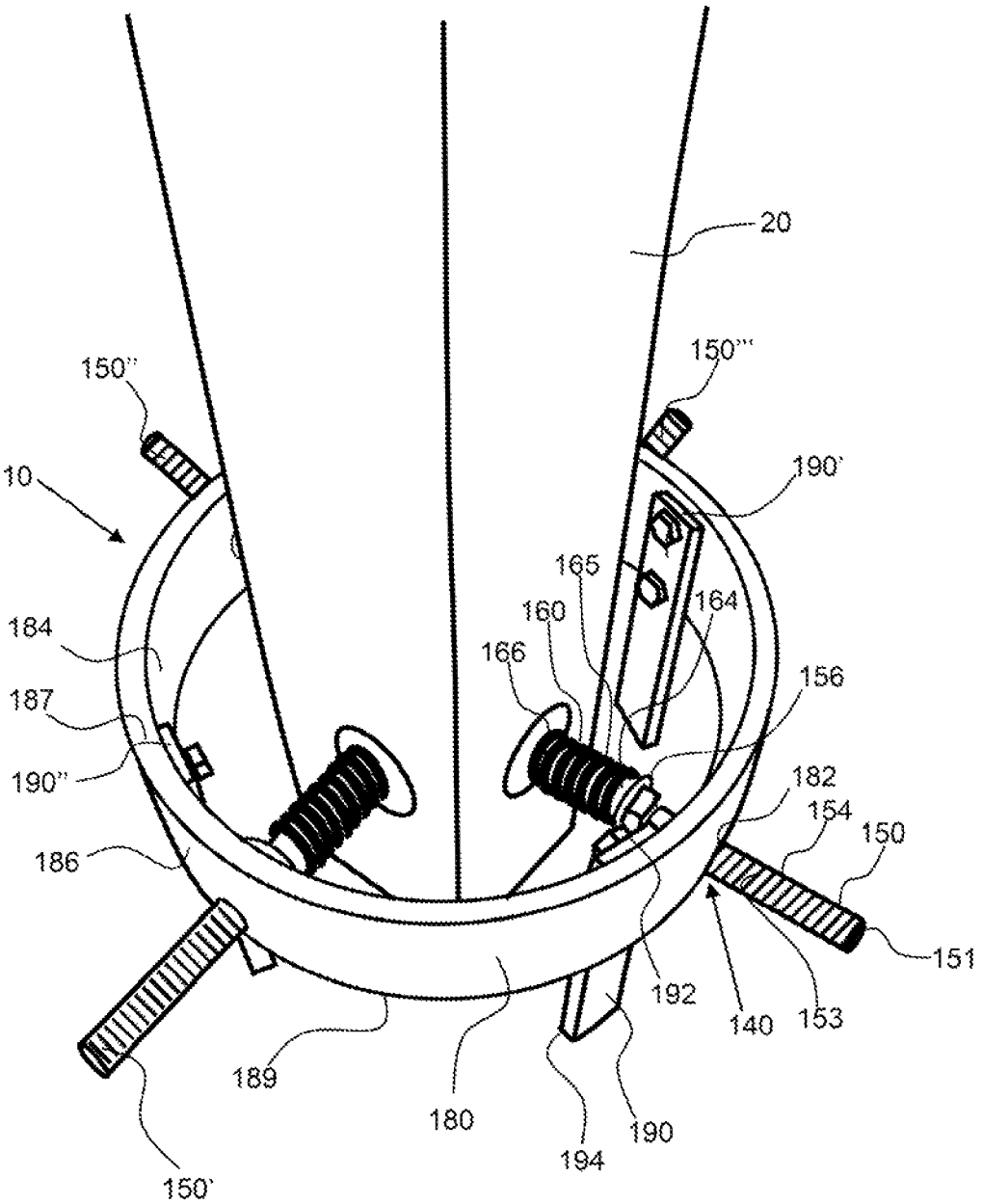
FIG. 12 shows a perspective view of an exemplary self-rightening post system securing a post in an upright position with four adjustable retainer assemblies coupled to a collar.
Figure 13:
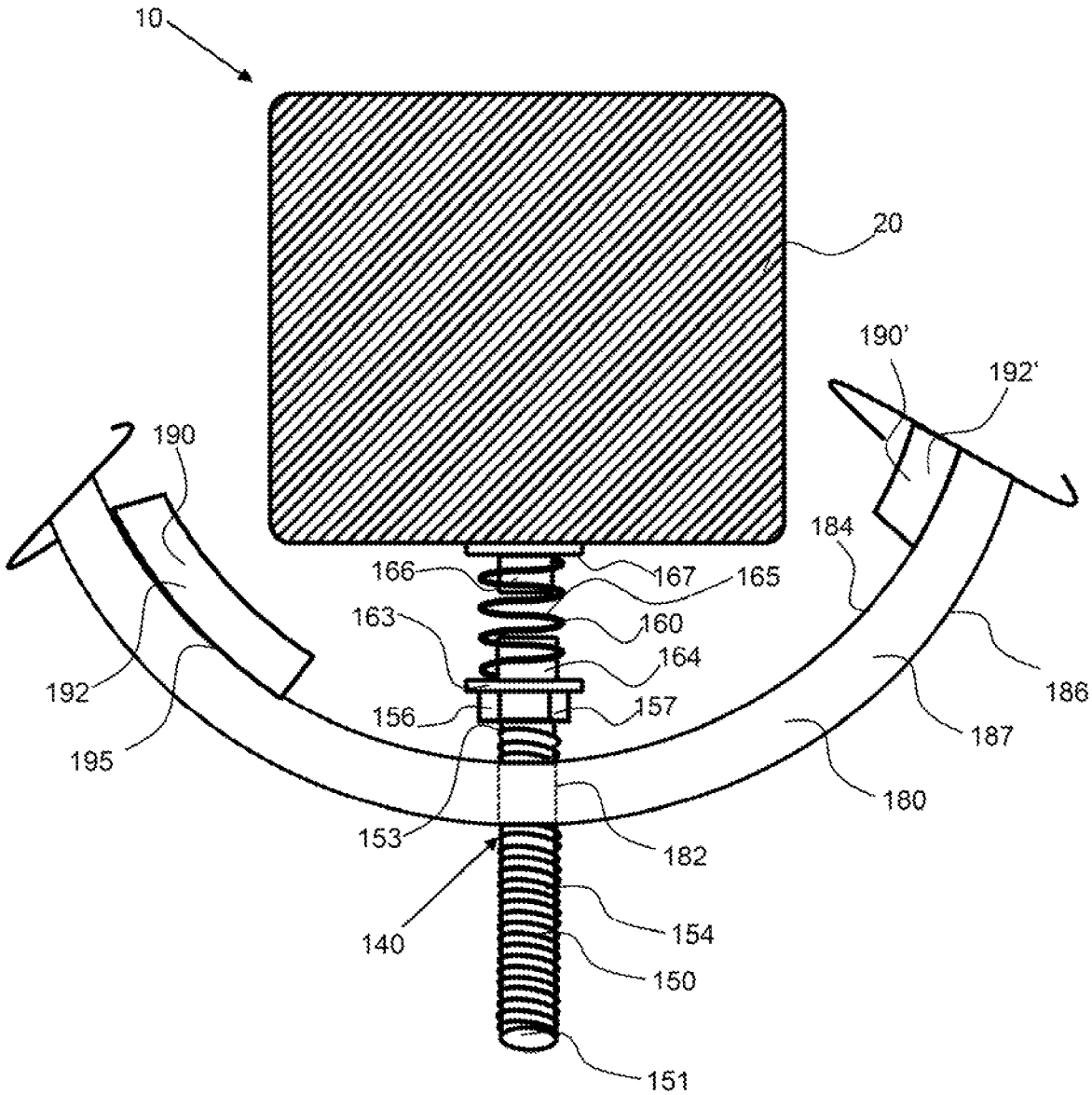
FIG. 13 shows a top view of an exemplary self-rightening post system securing a post in an upright position with four adjustable retainer assemblies coupled to a collar and a free spring portion configured between an adjustment spring coupler and a post spring coupler.
Figure 14:
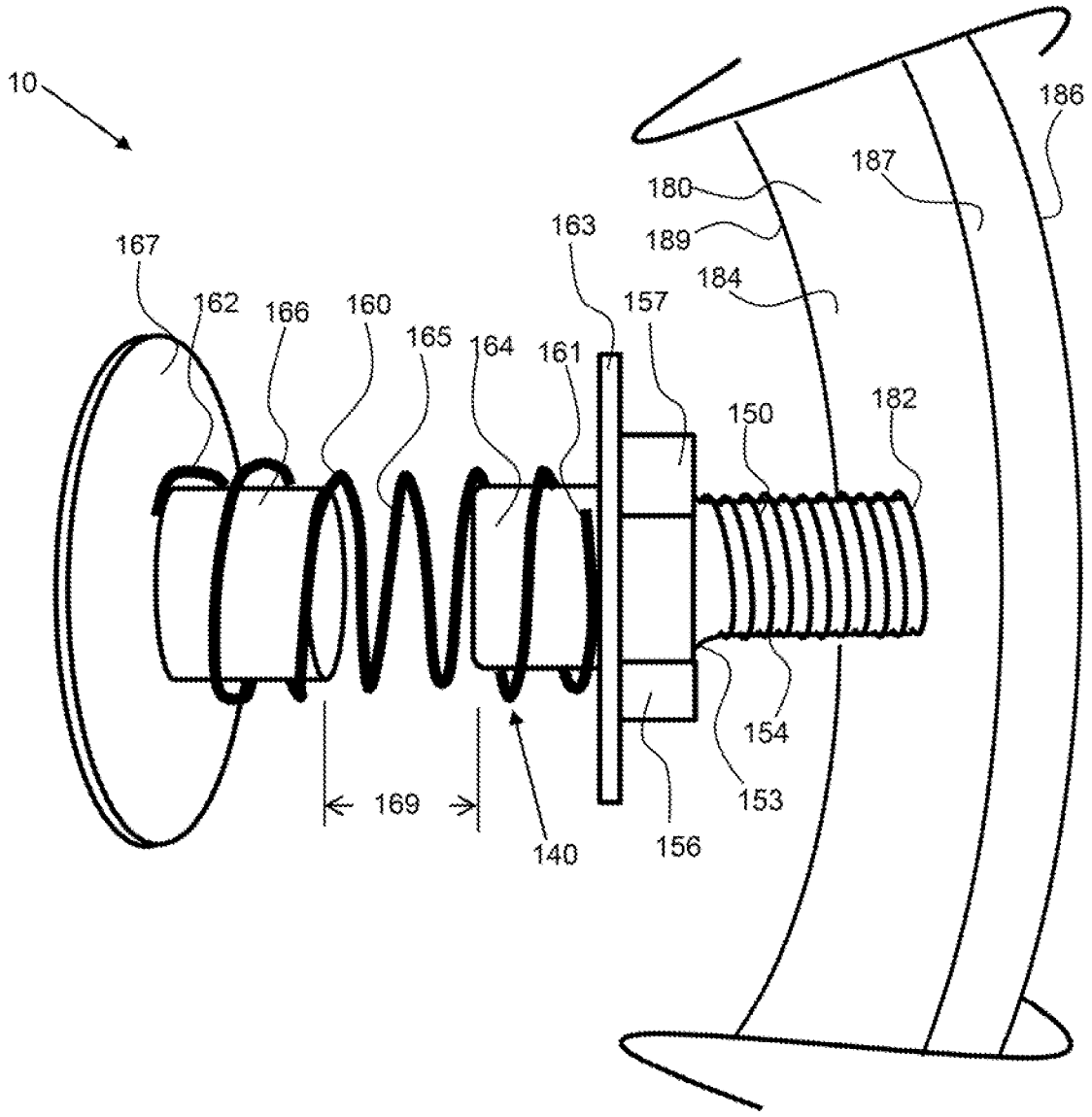
FIG. 14 shows a top view of an exemplary adjustable retainer assembly configured between a collar and a post, wherein the adjustment feature, such as a nut or bolt head for example, can be turned to adjust the compression of the spring against the post.

Referring now to FIGS. 12 to 14, an exemplary self-rightening post system 10 is configured to secure a post 20 in an upright position with four adjustable retainer assemblies 140 coupled to a collar 180. The compression of the spring 160 is adjusted by adjusting, such as by turning, the adjustment feature 156, such as a nut 157, to move the adjustment extension 150 into or out of the collar. The adjustment extension has a threaded portion 154 that is threaded through the threaded collar aperture 182 and the adjustment extension extends from the adjustment end 153 to an extended end 151. The adjustment feature may be coupled with the adjustment extension inside of the collar to provide access to the adjustment feature when configured over a casing in a hole. The spring 160 is coupled to the adjustment extension by the adjustment spring coupler 164 that may extend into the interior of the spring coil. An adjustment flange 163 may be configured between the adjustment feature 156 and the spring to provide a planar surface for applying force on the spring. The spring extends from an attached end 161 to a post end 162 and has a free spring portion 165 that enables the spring to bend and flex between the attached end and the post end. A post spring coupler 166 may extend into the interior of the spring coil and may be coupled with a post flange 167. The post flange may be coupled to the post end 162 of the spring and be configured against the post 20 to provide a planar surface for applying force to the post. The post flange 167 and/or the adjustment flange 163 may extend radially outward from the spring coupler and be disc shaped. The free spring portion extends a free spring length 169, as shown in FIG. 14, which allows the adjustable retainer assembly to enable movement or tilting of the post within the casing. The arrangement of the plurality of adjustable retainer assemblies around the post self-rightens the post after being knocked or bumped from a desired vertical orientation.

The collar 180 may be configured below ground level and the adjustment features may be adjusted to move the adjustment extension outward through the collar to allow insertion of a post into the collar and between the adjustable retainer assemblies. The adjustment features may then be turned until the post spring couplers or post flanges engage with the surface of the post. A level may be used to further adjust the adjustable retainer assemblies to provide the desired vertical orientation and to produce enough retainer force against the post.

The exemplary collar 180 is a ring and may be configured for placement over a casing, that extends down along a post. A shown in FIG. 12, an exemplary adjustable retainer assembly may comprise retainer extensions 190-190" that extend down from an inside surface 184 of the collar to engage with an inside surface of a casing. The retainer extensions have a length from an attached end 192 to an extended end 194 and may be detachably attachable to the collar 180, such as by fasteners or bolts, as shown. As shown in FIG. 13, the retainer extensions may have a radiused surface 195 to provide better engagement and alignment with the inside surface of the collar and the casing. As shown in FIG. 12, it may be desirable to have a plurality of discrete retainer extensions to reduce friction between the retainer extension and the casing upon insertion or during rotation. The collar is configured to spin with respect to the casing to enable the post to be rotationally offset from a force without damaging the post or the adjustable retainer assembly. Also, this spinning feature enables the post to be rotationally positioned as desired, such as when a sign is attached to the post. The collar has thickness from the inside surface 184 to the outside surface 186 and a height from a top 187 to the bottom 189. The thickness of the collar may be greater or less than that of a casing, however it may be preferred that the inside diameter of the collar be effectively the same as the inside diameter of a casing to enable the retainer extensions to extend directly down along the inside surface of the casing from the inside surface of the collar.

Figure 15:
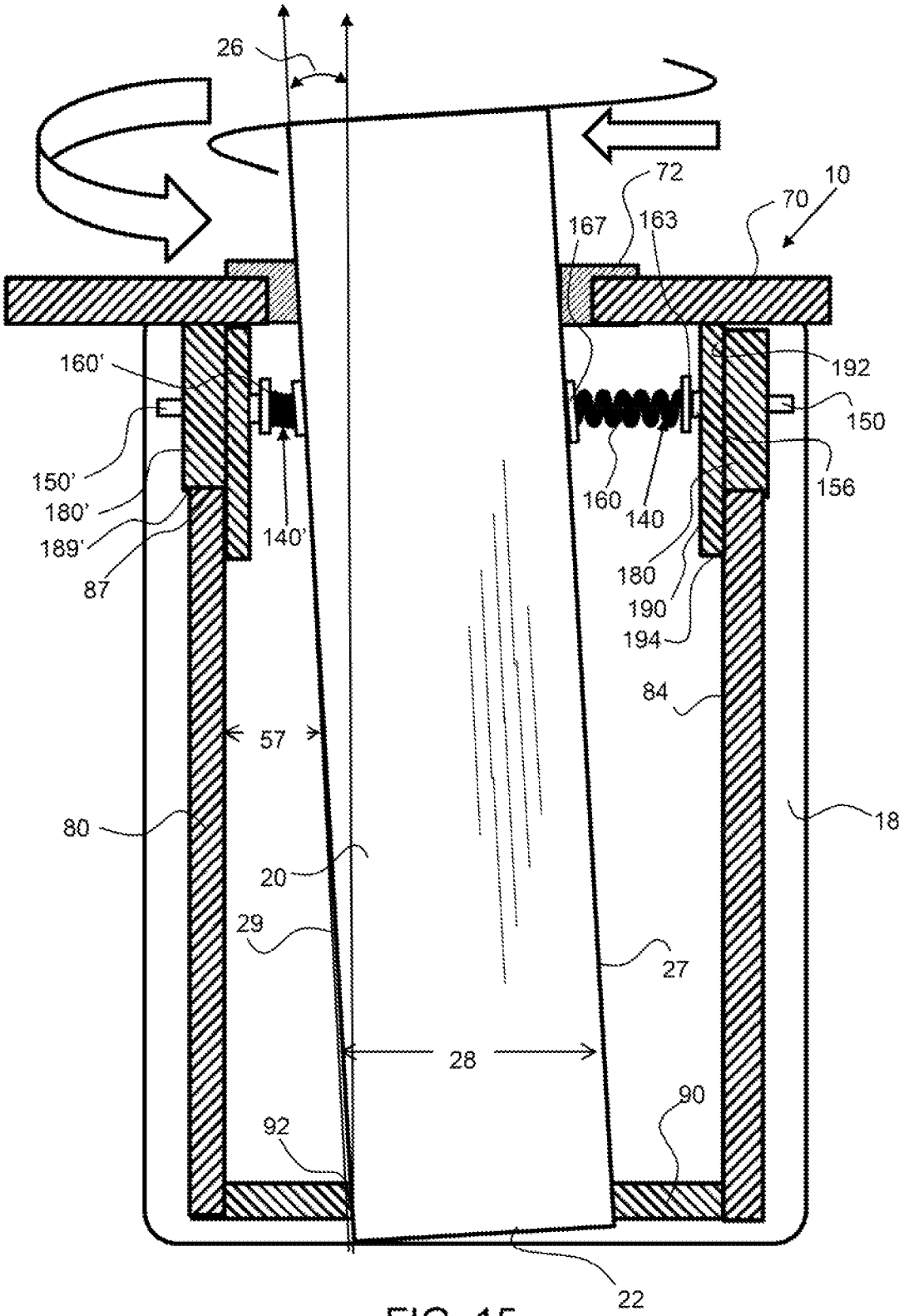
FIG. 15 shows a side view diagram of the exemplary self-rightening post system with the post deflected by a force to an offset angle from vertical and the adjustable retainer assemblies forcing the post back toward a vertical orientation.

As shown in FIG. 15, an exemplary self-rightening post 20 is deflected by a force to an offset angle 26 from vertical and the adjustable retainer assemblies 140, 140' are forcing the post back toward a vertical orientation. The gap distance 57 between the post 20 and the casing 80 is smaller on one side of the post than the gap distance 57' on the opposing side of the post. The spring 160' of the adjustable retainer assembly 140' is in compression while the spring 160 of the adjustable retainer assemblies 140 is in tension to provide a self-rightening force on the offset post. The bottom 189' of the collar 180 rest on the top 87 of the casing 80. The inside diameter of the collar is effectively the same as the inside diameter of the casing to allow the retainer extensions to extend directly down along both inside surfaces.

A retainer extension 190 extends down from an attached end 192, attached with the collar, to an extended end 194. The retainer extension extends along an inside surface 84 of the casing 80 to retain the collar 180 over the casing. The retainer extensions may be detachably attachable and there may be a plurality of retainer extensions to provide an effective amount of retaining force on the collar, even when the post is deflected by a force. A top plate 70 is configured over the collar and moves when the post 20 is deflected, as shown. A flange 167 may be configured between the top plate and the post to prevent water from entering into the hole 18 or casing.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A self-rightening post system comprising:

a) a collar for receiving a post therethrough and having a plurality of threaded collar apertures;

b) a plurality of adjustable retainer assemblies coupled to the collar and wherein each of said plurality of adjustable retainer assemblies comprises:

i) an adjustment extension comprising:

1. a threaded portion that extends through said threaded collar aperture:
2. a length from an extended end to an adjustment end; wherein the extended end is outside of the collar and the adjustment end extends into the collar;
3. an adjustment feature for turning the adjustment extension within the threaded collar aperture ii) a spring coupled to the adjustment extension and extending inward from the collar and comprising:

1. an attached end, coupled to the adjustment extension,
2. a post end, opposite the attached end;
3. a length from the attached end to the post end;

wherein the spring has a free spring portion between the attached end and the post end to enable the spring to compress when a post is offset by a deflecting force;

whereby the plurality of adjustable retainer assemblies are configured to self-righten said post after being defected by a deflecting force.

2. The self-rightening post system of claim 1, further comprising a casing that extends down along the post from a bottom of the collar.

3. The self-rightening post system of claim 2, further comprising a retainer extension that is attached to the collar and extends down along an inside surface of the casing to secure the collar over the casing.

4. The self-rightening post system of claim 3, comprising a plurality of discrete retainer extensions configure around an inside surface of the collar.

5. The self-rightening post system of claim 1, wherein the collar is circular and wherein the post is configured to rotate within the collar.

6. The self-rightening post system of claim 1, further comprising an adjustment spring coupler that couples the attached end of the spring to the adjustment extension.

7. The self-rightening post system of claim 6, wherein the adjustment spring coupler is cylindrical in shape and extends inside of the spring.

8. The self-rightening post system of claim 6, wherein the adjustment spring coupler comprises an adjustment flange configured between the spring and the adjustment extension.

9. The self-rightening post system of claim 6, further comprising a post spring coupler coupled to the post end of the spring.

10. The self-rightening post system of claim 9, wherein the post spring coupler is cylindrical in shape and extends inside of the spring.

11. The self-rightening post system of claim 9, wherein the post spring coupler comprises a post flange on an extended end to retain the post end of the spring.

12. The self-rightening post system of claim 1, further comprising a post spring coupler coupled to the post end of the spring.

13. The self-rightening post system of claim 12, wherein the post spring coupler is cylindrical in shape and extends inside of the spring.

14. The self-rightening post system of claim 12, wherein the post spring coupler comprises a post flange on an extended end to retain the post end of the spring.

15. The self-rightening post system of claim 1, wherein the plurality of adjustable retainer assemblies are configured on at least two opposing sides of the post.

16. The self-rightening post system of claim 1, wherein said post is rectangular in cross-section.

17. The self-rightening post system of claim 1, wherein the adjustment feature of the adjustment extension is a polygonal head that is fixed to the threaded portion.

18. The self-rightening post system of claim 1, wherein the adjustment feature is configured inside of the collar.

19. The self-rightening post system of claim 1, wherein the post is rectangular in cross sectional shape having four sides and wherein the self-rightening post system has four adjustable retainer assemblies with one of the adjustable retainer assemblies configured on each of the four sides of the post.

20. The self-rightening post system of claim 1, further comprising a top-plate having a top plate aperture, wherein the post extends up through the top plate aperture, and wherein the top-plate is configured to slide with the post over the collar.

21. The self-rightening post system of claim 1, further comprising a base retainer configured below the plurality of adjustable retainer assemblies and wherein the base retainer comprises a base retainer receiver to extend around an insert end of the post.

* * * * *